US010668738B1

(12) United States Patent
Riley et al.

(10) Patent No.: US 10,668,738 B1
(45) Date of Patent: Jun. 2, 2020

(54) INKJET PRINTED LIVERY APPLICATION PROCESS

(71) Applicant: The Boeing Company, Chicago, IL (US)

(72) Inventors: Terrell D. Riley, Summerville, SC (US); Alexandra E. Corona, Summerville, SC (US); Bennett M. Moriarty, Seattle, WA (US); Ryan M. Trumbo, Kent, WA (US); Kjersta L. Larson-Smith, Seattle, WA (US); Jill E. Seebergh, Seattle, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 16/226,045

(22) Filed: Dec. 19, 2018

(51) Int. Cl.

| | |
|---|---|
| ***B41J 3/407*** | (2006.01) |
| ***B41J 2/045*** | (2006.01) |
| ***B41J 2/02*** | (2006.01) |
| ***B41J 3/00*** | (2006.01) |
| ***B41J 3/413*** | (2006.01) |
| ***B41M 5/00*** | (2006.01) |
| ***B41M 7/00*** | (2006.01) |
| *B41J 11/00* | (2006.01) |

(52) U.S. Cl.
CPC ..... *B41J 3/407* (2013.01); *B41J 2/02* (2013.01); *B41J 2/04586* (2013.01); *B41J 3/00* (2013.01); *B41J 3/4073* (2013.01); *B41J 3/413* (2013.01); *B41M 5/0011* (2013.01); *B41M 7/00* (2013.01); *B41M 7/0027* (2013.01); *B41J 11/0015* (2013.01); *B41J 2002/022* (2013.01)

(58) Field of Classification Search
CPC . B41J 3/407; B41J 3/413; B41J 3/4073; B41J 3/00; B41J 2/04586; B41J 2/02; B41J 11/0015; B41J 2002/022; B41M 7/0027; B41M 7/00; B41M 5/0011
See application file for complete search history.

(56) References Cited

U.S. PATENT DOCUMENTS

| | | | | |
|---|---|---|---|---|
| 7,207,651 | B2 | 4/2007 | Amemiya | |
| 8,851,638 | B2 | 10/2014 | Ellinger | |
| 2001/0031352 | A1* | 10/2001 | Yamamori | B05D 5/067 428/324 |
| 2006/0172069 | A1* | 8/2006 | Vega | B41M 5/0256 427/256 |

* cited by examiner

*Primary Examiner* — Justin Seo
(74) *Attorney, Agent, or Firm* — Miller, Matthias & Hull LLP

(57) ABSTRACT

A method of treating a contoured surface with surface treatment layer includes applying a surface preparation layer along the contoured surface and applying a basecoat layer on top of the surface preparation layer. The method further includes stabilizing the basecoat layer to prepare a basecoat surface along the basecoat layer for one or more subsequent layers of the surface treatment coating and jetting a decorative livery layer along the contoured surface using one or more ink jet print heads. The method further includes applying an adhesion promoter on top of the decorative livery layer and stabilizing the adhesion promoter layer to produce a desired bonding surface along the adhesion promoter layer. Additionally, the method includes applying a clear coat layer to cover the underlying decorative livery layer, the basecoat layer and the surface preparation layer.

20 Claims, 4 Drawing Sheets

INKJET PRINTED LIVERY APPLICATION PROCESS

FIELD

The present disclosure relates generally to automated surface treatment systems and methods, and more specifically to automated surface treatment systems and methods for contoured surfaces.

BACKGROUND

Treating and coating structural surfaces of machines, such as commercial aircraft, is a long and extensive process. Surface treatment often requires coating a structural surface that includes a variety of large contoured surfaces. Furthermore, coating the structural surfaces includes applying multiple layers of coatings for engineering properties, as well as to apply a decorative livery. The decorative livery is traditionally applied using a complex process which requires a series of masking operations followed by applying colored paints or coatings where they are needed. These masking and painting operations are serially repeated until the exterior surface treatment is completed. Performing these processes on large areas with a variety of contoured surfaces, therefore, requires a significant amount of time and resources.

SUMMARY

In accordance with one aspect of the present disclosure a method of treating a contoured surface with a surface treatment layer is disclosed. The method may include applying a surface preparation layer along the contoured surface and applying a basecoat layer on top of the surface preparation layer and along the contoured surface. The method may further include stabilizing the basecoat layer to prepare a basecoat surface for one or more subsequent layers of the surface treatment coating. Moreover, the method may include jetting a decorative livery layer along the contoured surface using one or more ink jet print heads. Additionally, the method may include applying an adhesion promoter on top of the decorative livery layer and stabilizing the adhesion promoter layer to produce a desired bonding surface along the adhesion promoter layer. The method may further include applying a clear coat layer to cover the underlying decorative livery layer, the basecoat layer and the surface preparation layer.

In accordance with another aspect of the present disclosure, a method of applying a decorative livery coating along an outer contoured surface of an airplane fuselage is disclosed. The method may include positioning the airplane fuselage within a work area and preparing the outer contoured surface of the airplane fuselage for receiving a surface treatment layer. Furthermore, the method may include applying a surface preparation layer along the outer contoured surface. The method may further include jetting a decorative livery layer along the contoured surface using one or more ink jet print heads. The method may include applying an adhesion promoter layer on top of the decorative livery layer and stabilizing the adhesion promoter layer to generate a desired surface energy along the adhesion promoter layer. Additionally, the method may include applying a clear coat layer to cover the underlying decorative livery layer, the basecoat layer and the surface preparation layer.

In accordance with yet another aspect of the present disclosure a method of ink jetting a decorative livery coating along an outer contoured surface of an aircraft using a surface treatment assembly with one or more ink jet print heads is disclosed. The method may include applying a surface preparation layer along the outer contoured surface, the surface preparation layer includes one or more of a surface film, a sol-gel layer, a primer layer and an intermediate layer. The method may further include applying a basecoat layer on top of the surface preparation layer and along the outer contoured surface curing sufficiently to stabilize the basecoat layer. The method may further include jetting a decorative livery layer along the contoured surface using the one or more ink jet print heads. The method may further include flashing one or more volatile components from the decorative livery layer and applying an adhesion promoter layer on top of the decorative livery layer. Furthermore, the method may include stabilizing the adhesion promoter layer to generate a desired surface energy along the adhesion promoter layer and applying a clear coat layer to cover the underlying decorative livery layer, the basecoat layer and the surface preparation layer.

The features, functions, and advantages disclosed herein can be achieved independently in various embodiments or may be combined in yet other embodiments, the details of which may be better appreciated with reference to the following description and drawings.

It should be understood that the drawings are not necessarily to scale, and that the disclosed embodiments are illustrated diagrammatically, schematically, and in some cases in partial views. In certain instances, details which are not necessary for an understanding of the disclosed methods and apparatuses or which render other details difficult to perceive may have been omitted. It should be further understood that the following detailed description is merely exemplary and not intended to be limiting in its application or uses. As such, although the present disclosure is for purposes of explanatory convenience only depicted and described in illustrative embodiments, the disclosure may be implemented in numerous other embodiments, and within various systems and environments not shown or described herein.

DETAILED DESCRIPTION

The following detailed description is intended to describe both methods and devices for carrying out the disclosure. Actual scope of the disclosure is as defined by the appended claims.

Figure 1:
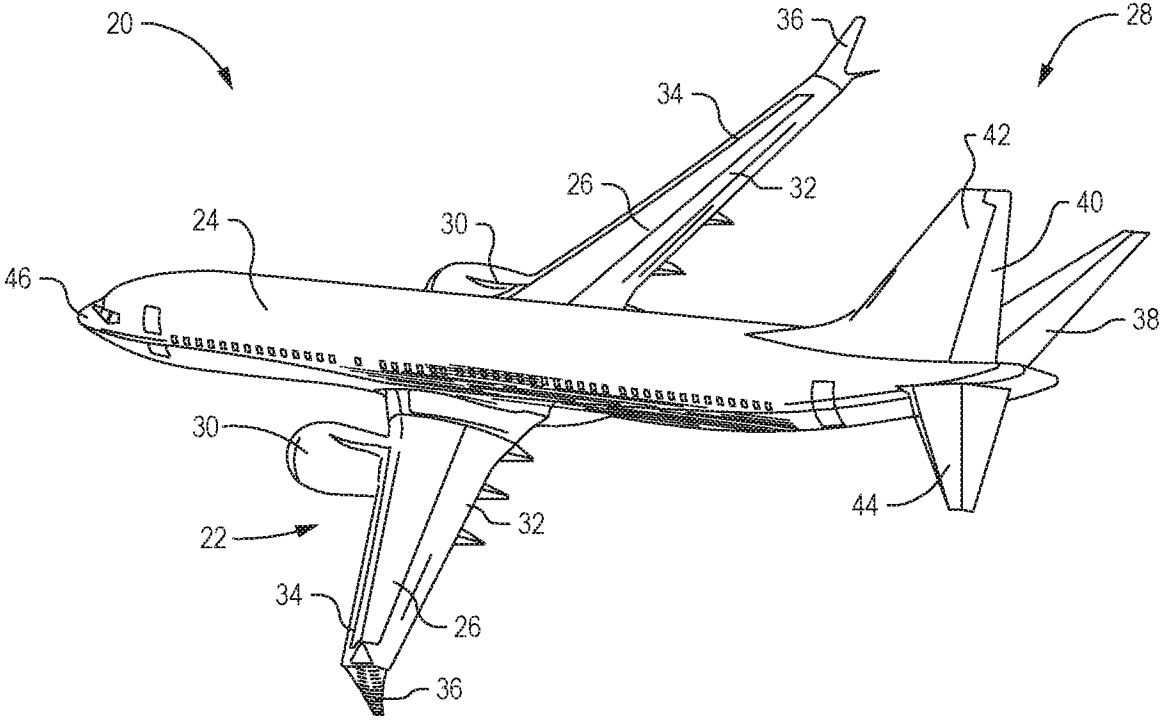
FIG. 1 is a perspective view of an exemplary vehicle constructed in accordance with the present disclosure.

Referring to FIG. 1, a vehicle 20 is illustrated. One non-limiting example of the vehicle 20 is that of an aircraft; however the present disclosure applies to other types of vehicles and machines as well. As illustrated, the vehicle 20 is configured with an airframe 22 which includes a fuselage 24, wings 26, a tail section 28 and other such components. In some embodiments, one or more propulsion units 30 are coupled to each wing 26 in order to propel the vehicle 20 in a direction of travel. Furthermore, the wings 26 are fixedly attached to the fuselage 24 and the propulsion units 30 are attached to an underside surface of the wing 26; however other attachment locations of the propulsion units 30 are possible. In some embodiments, the wings 26 are positioned at a substantially centered position along the fuselage 24, and the wings 26 are configured to include a plurality of flaps 32, leading edge devices 34, and peripheral edge devices 36 (i.e., winglets). Moreover, during operation of the vehicle 20, the flaps 32, leading edge devices 34 and peripheral edge devices 36 are capable of being adjusted in a plurality of positions in order to control and stabilize the vehicle 20. For example, the flaps 32 and leading edge devices 34 are adjustable in several different positions to produce the desired lift characteristics of the wings 26. Additionally, the tail section 28 of the airframe 22 includes components which provide other stability and maneuverability functions of the vehicle 20, such as an elevator 38, a rudder 40, a vertical stabilizer fin 42, and a horizontal stabilizer 44.

Figure 2:
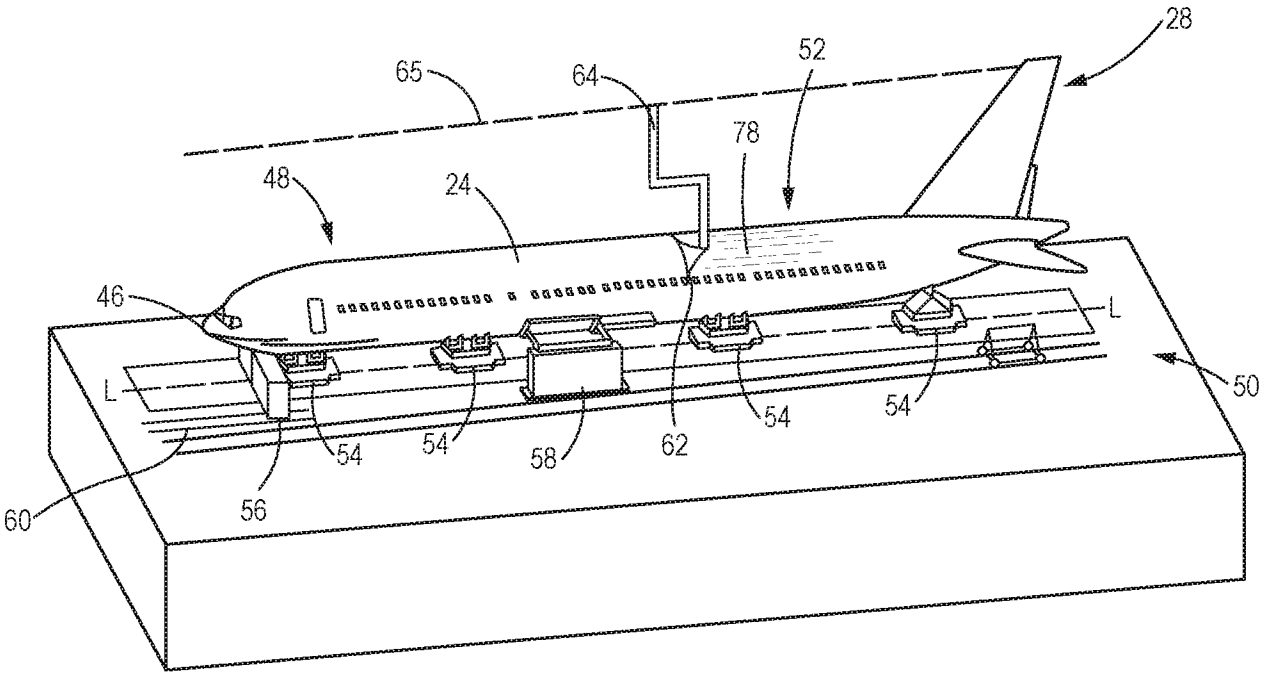
FIG. 2 is a perspective view of an exemplary contoured surface, and surface treating assembly in accordance with the present disclosure.

FIG. 2 illustrates one non-limiting example of the fuselage 24 and the tail section 28 prior to attachment of the wings 26 (FIG. 1). Generally, the fuselage 24 and other components of the vehicle 20 are constructed out of aluminum, aluminum alloy, titanium, carbon composite, or other known material and any combinations thereof. Moreover, the fuselage 24 generally defines a tubular structure that serves as the main body portion of the vehicle 20. In some embodiments, a nose portion 46 is designated as the front of the fuselage 24 and the tail section 28 is designated as the rear of the fuselage 24. Additionally, the fuselage 24 is an elongated structure which exhibits changing dimensions and topography along the length of the fuselage 24 between the nose portion 46 and the tail section 28. As a result, the fuselage 24 is often described as having a contoured outer surface 48 or other such surface profile. In one embodiment, the contoured outer surface 48 includes a variety of surface profiles formed by a series of changing surface geometries of the fuselage 24. For example, moving along the fuselage 24 from the nose portion 46 to the tail section 28 the contoured outer surface 48 exhibits changing geometries and profiles such as but not limited to, an increase or decrease in diameter, a convex surface, a concave surface, or other such surface geometries and profiles or combination thereof. While, the fuselage 24 is discussed here, it will be understood that the wings 26, tail section 28, peripheral edge device 36 and other vehicle 20 components will also have the contoured outer surface 48, as defined by a variety of surface geometries for each vehicle 20 component.

During vehicle 20 manufacture and/or servicing, the fuselage 24, is positioned within a work area 50 and prepared for one or more manufacturing and/or scheduled service steps. In some embodiments, the manufacturing and/or servicing of the vehicle 20 includes applying a surface treatment on the contoured outer surface 48 along the fuselage 24. Furthermore, the surface treatment is also applied to the wings 26, tail section 28, and/or other portion of the vehicle 20. Generally, the surface treatment of the contoured outer surface 48 includes one or more of cleaning, abrading, priming, painting, protecting, repairing, or other such treatment to the contoured outer surface 48 or other such outer surface of the vehicle 20. Moreover, one non-limiting example of the surface treatment includes applying a surface treatment coating 52 along the contoured outer surface 48 of the fuselage. In one embodiment, the surface treatment coating 52 includes applying one or more layers or coatings to the contoured outer surface 48 of the vehicle 20, such as but not limited to, a surface protective layer, an adhesion promoter layer, a primer layer, a basecoat layer, a top coat layer, a clear coat layer, a decorative livery layer, or other known layer and/or coating. Accordingly, the surface treatment coating 52 provides protection to the outer surface of the fuselage 24 or other vehicle 20 portion against corrosion and other such harsh environmental conditions encountered during operation. Additionally, as mentioned above, one layer included in the surface treatment coating 52 is a decorative livery layer 78 that is applied along the fuselage 24 that helps to identify and distinguish the one vehicle 20 from another.

As further illustrated in FIG. 2, the fuselage 24 is prepared for one or more surface treatments by positioning the fuselage 24 within the work area 50 prior to the attachment of the wings 26 and other components to the vehicle 20. However, in alternative embodiments, such as but not limited to, an alternative manufacturing process flow or during service or maintenance of the vehicle 20, the surface treatment is possible with the wings 26, the tail section 28 and other components already attached to vehicle 20. Prior to the start of the surface treatment, the fuselage 24 is delivered to the work area 50 by a plurality of automated guided vehicles 54 (AGVs). The AGVs are positioned along the underside of the fuselage 24 to provide adequate support and configured to move the fuselage 24 into position. While FIG. 2 shows the use of four AGVs 54, other numbers (i.e., fewer or greater) are certainly possible.

After the AGVs 54 move the fuselage into the work area 50, one or more support structures are positioned along the underside of the fuselage 24 to provide support during the surface treatment. In some embodiments, a nose support structure 56 is located on the underside of the nose portion 46 of the fuselage 24 and a central support structure 58 is positioned underneath of the central portion of the fuselage 24. Additionally, while the nose support structure 56 and the central support structure 58 are shown in FIG. 2, one or more additional support structures can be placed in other places along the fuselage 24 which require support, such as but not limited to, underneath the tail section 28.

In one non-limiting embodiment, the nose and central support structures 56, 58 are slidably supported by a set of support structure rails 60 and the nose and central support structures 56, 58 slide along the support structure rails 60 and are positioned underneath the fuselage 24 to provide the necessary support. Furthermore, the nose and central support structures 56, 58 are configured such that they are able to move along the support structure rails 60 without interfering with the AGVs 54. As a result, the AGVs 54 are capable of being used along with the nose and central support structures 56, 58 to support the fuselage 24, or other component of the vehicle 20, during surface treatment. While FIG. 2 illustrates the use of AGVs 54 and the nose and central support structures 56, 58 to transport and support the fuselage 24 and other components of the vehicle 20, it will be known to those skilled in the art that other methods of positioning, supporting and transporting the fuselage 24 and other vehicle 20 components are possible.

As further illustrated in FIG. 2, the work area 50 is equipped with a surface treatment assembly 62 that is configured to apply one or more layers of the surface treatment coating 52 along the contoured outer surface 48 of the vehicle 20. In some embodiments, the surface treatment assembly 62 is attached to a gantry 64, which is configured to provide support and movement of the surface treatment assembly 62 within the work area 50. In one non-limiting example, the gantry 64 is attached to an overhead structure 65 that runs the length L-L of the work area 50 that houses the fuselage 24 or other components of the vehicle 20 during surface treatment. Accordingly, the gantry 64 is controlled to move the surface treatment assembly 62 along the length L-L of the work area 50 as it applies the surface treatment coating 52 along the contoured outer surface 48 of the fuselage 24 or other vehicle 20 component. While FIG. 2 illustrates the surface treatment assembly 62 operably coupled to the gantry 64 it will be understood that an AGV (not shown) or other such piece of equipment can be positioned on the floor, or other such location, of the work area 50 and used to support and move the surface treatment assembly 62 to apply the surface treatment coating 52 along the contoured outer surface 48.

Figure 3:
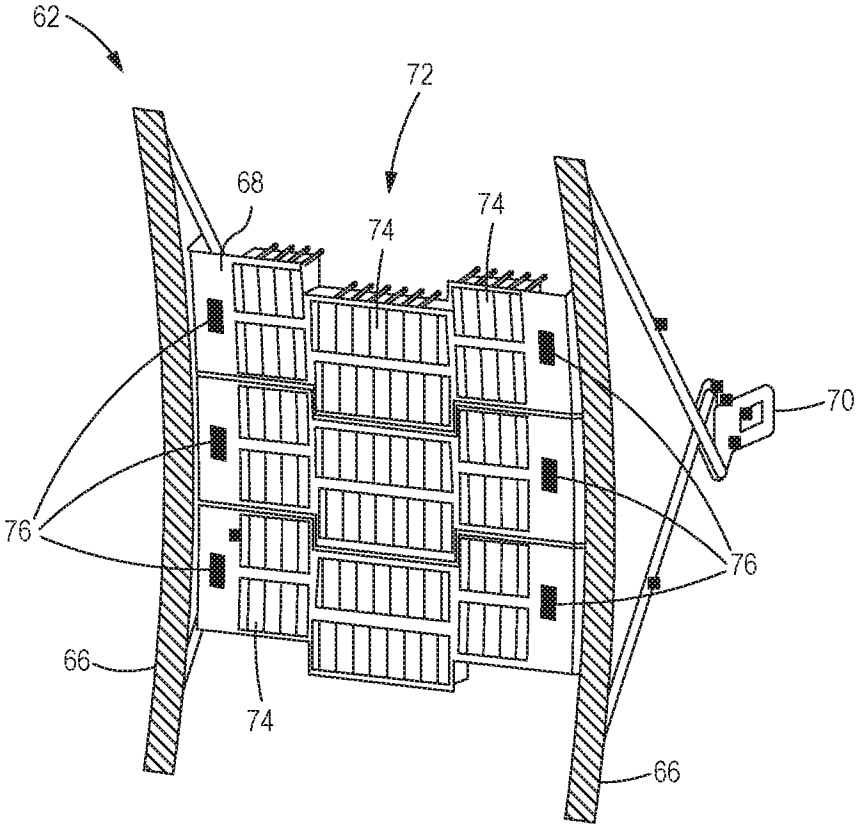
FIG. 3 is a perspective view of an exemplary surface treating assembly in accordance with the present disclosure.

Referring now to FIG. 3, one non-limiting example of the surface treatment assembly 62 is shown. As discussed above, the surface treatment assembly 62 is operably coupled to the gantry 64 (FIG. 2) which is controlled to move the surface treatment assembly 62 and apply the surface treatment coating 52 (FIG. 2) along the fuselage 24 (FIG. 2). Furthermore, an embodiment of the surface treatment assembly 62 includes an adjustable base 66, a plurality of surface treatment applicator heads 68, and at least one actuator 70 coupled to the adjustable base 66 of the surface treatment assembly 62. The plurality of surface treatment applicator heads 68 apply one or more layers of the surface treatment coating 52. The at least one actuator 70 is configured to adapt the adjustable base 66 of the surface treatment assembly 62 to conform and follow the variety of surface geometries (i.e., increased/decreased radii, and convex/concave surfaces) encountered along the contoured outer surface 48 of the fuselage 24, or other portion of the vehicle 20. Accordingly, the at least one actuator 70 can be actively controlled to adjust the adjustable base 66 in order to maintain a desired positioning of the plurality of surface treatment applicator heads 68 relative to the contoured outer surface 48 (FIG. 2). As a result, the surface treatment assembly 62 provides a versatile and responsive treatment device to apply one or more layers of the surface treatment coating 52 along the complex geometries of the contoured outer surface 48.

The plurality of surface treatment applicator heads 68 are arranged into an applicator head array 72 configured to apply one or more layers of the surface treatment coating 52, or other such surface treatment, onto the contoured outer surface 48 of the fuselage 24. In some embodiments, the plurality of surface treatment applicator heads 68 include one or more ink jet print heads 74 configured to dispense a surface coating (i.e., ink for decorative livery layer 78) on the contoured outer surface 48 of the fuselage 24, or other portion of the vehicle 20. Additionally or alternatively, the surface treatment applicator heads 68 are configured with one or more spray applicators, or other such device, to dispense a primer layer, a surface filler layer, a clear coat layer or other such layer.

Furthermore, in some embodiments, to supplement the adjustability of the adjustable base 66, the applicator head array 72 also includes adjustment capabilities to account for the changing geometries of the contoured outer surface 48. In one non-limiting example, the plurality of surface treatment applicator heads 68 is independently adjustable according to the changing dimensions and complex topography of the contoured outer surface 48 of the fuselage 24. In an embodiment, the applicator head array 72 and the plurality surface treatment applicator heads 68 are independently controllable and adjustable in order to maintain a specified gap between the plurality of surface treatment applicator heads 68 of the applicator head array 72 and the contoured outer surface 48 of the fuselage 24. Furthermore, in some embodiments the changing geometries and surface profile of the contoured outer surface 48 require that each of the surface treatment applicator heads 68 that dispense the decorative livery layer 78, or other such layer of the surface treatment coating 52, are continuously monitored and adjusted to maintain the specified dispense gap and a normal or orthogonal orientation between the plurality of surface treatment applicator heads 68 and the contoured outer surface 48 of the fuselage 24, or other portion of the vehicle 20 being treated.

Accordingly, in order to provide the individual control and adjustment capabilities, some embodiments of the applicator head array 72 and the plurality of surface treatment applicator heads 68 include at least one surface treatment assembly sensor 76 attached and positioned around the surface treatment assembly 62. The at least one surface treatment assembly sensor 76 is adjacently positioned to at least one of the surface treatment applicator heads 68 incorporated into the applicator head array 72. The surface treatment assembly sensor 76 is configured to scan and collect surface topography data and other surface profile data such as but not limited to, surface imaging data, surface location/positioning data, height sense data, angular orientation data, and any other such data related to the control and adjustment of the surface treatment assembly 62.

Referring back to FIG. 2 with continued reference to FIG. 3, the surface treatment assembly 62 applies the surface treatment coating 52, or other such surface treatment layer, to the contoured outer surface 48 of the fuselage 24 or other portion of the vehicle 20. In one embodiment, the plurality of surface treatment applicator heads 68 of the applicator head array 72 applies one or more layers of the surface treatment coating 52 to the contoured outer surface 48 as the surface treatment assembly 62 is moved along the fuselage 24 by the gantry 64. Additionally or alternatively, the surface treatment assembly 62 can be operatively attached to an AGV or other such automated device which is capable of positioning the surface treatment assembly 62. Moreover, one non-limiting example of the surface treatment coating 52 includes a plurality of layers or surface treatments, such as but not limited to, a surface protective layer, an adhesion promoting layer, a primer layer, a basecoat layer, a top coat layer, a clear coat layer, a decorative livery layer, or other known layer or coating. Accordingly, the surface treatment assembly 62 is configured, as needed, to dispense and apply each layer of the plurality of layers included in the surface treatment coating 52. For example, the surface treatment assembly 62 is configured to include one or more different applicator devices to apply the one or more layers of the surface treatment coating 52. For example, the surface treatment assembly 62 can be configured with one or more ink jet print heads 74 to apply the decorative livery layer 78 along the contoured outer surface. The surface treatment assembly 62 may be further configured to include a spray applicator or other such material applicator to apply other layers included in the surface treatment coating 52. Alternatively, a plurality of surface treatment assemblies 62 can be utilized to apply the one or more coatings of the surface treatment coating 52.

Figure 4:
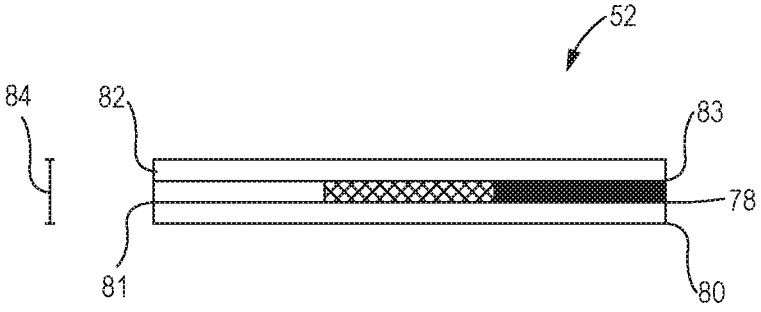
FIG. 4 is cross-sectional view of a surface treatment coating applied to the contoured surface, in accordance with the present disclosure.

In one non-limiting example, the surface treatment assembly 62 includes the plurality of ink jet print heads 74 which controllably jet or otherwise dispense a stream of ink droplets onto the contoured outer surface 48 of the fuselage 24 in order to apply or dispense one or more layers of the surface treatment coating 52 (i.e., the decorative livery layer 78). For example, FIG. 4, illustrates one non-limiting example of the surface treatment coating 52 which includes an exemplary decorative livery layer 78 applied by the plurality of ink jet print heads 74 of the surface treatment assembly 62. The ink jet print heads 74 include ink colors, such as but not limited to, cyan, magenta, yellow and black. As such, the ink jet print heads 74 are controlled to jet or otherwise dispense a plurality of ink droplets along the contoured outer surface 48 to create a desired decorative pattern. Moreover, the use of the ink jet print heads 74 allows for simultaneous dispensing of a plurality of colored droplets such that the decorative livery layer 78 is a substantially level ink layer (i.e., within dispensing/manufacturing tolerances) with negligible thickness variations between the variety of colors included in the decorative livery layer 78.

Furthermore, in some embodiments, the surface treatment coating 52 includes a surface preparation layer 80 that is applied to the contoured outer surface 48 prior to the decorative livery layer 78. As discussed above, the surface preparation layer 80 may be dispensed by the plurality of ink jet print heads 74, or alternatively, the surface treatment assembly 62 may be configured with a different set of applicators to apply the surface preparation layer 80. The outer surface of the fuselage 24 (i.e., contoured outer surface 48) is constructed from aluminum, aluminum alloy, titanium, carbon composite, other such material or combination thereof. Accordingly, the surface preparation layer 80 serves to protect the outer surface of the fuselage 24, as well as provide a high quality surface for the application of subsequent layers included in surface treatment coating 52.

In one embodiment, the surface preparation layer 80 includes one or more coatings such as but not limited to, a surface filler layer, a surface protectant layer, a surface primer layer, an intermediate coating layer, an adhesion promoter layer, and other such layers and coatings. Furthermore, following the application of the surface preparation layer 80, a basecoat layer 81 is applied to the contoured outer surface 48. The basecoat layer 81 provides a foundation for the decorative livery layer 78, as well as provides an additional protective layer to the outer surface of the fuselage 24. As such, the decorative livery layer 78 is deposited on top of the surface preparation layer 80 and the basecoat layer 81. In one non-limiting example, the plurality of ink jet print heads 74 apply the decorative livery layer 78 in a smooth and uniform manner that conforms the contour and surface profile of the contoured outer surface 48 of the fuselage 24.

As further shown in FIG. 4, an embodiment of the surface treatment coating 52 includes a clear coat layer 82 or other such protective layer that is applied on top of the decorative livery layer 78. The clear coat layer 82 is a transparent coating that protects the underlying decorative livery layer 78. Moreover, some embodiments of the surface treatment coating 52 include an adhesion promoter layer 83 deposited on top of the decorative livery layer 78. The adhesion promoter layer 83 serves to uniformly coat the decorative livery layer 78 and facilitate a strong bond between the decorative livery layer 78 and the clear coat layer 82. Additionally, the exemplary surface treatment coating 52 of FIG. 4 creates a multi-layer coating that conforms along the contoured outer surface 48 (FIG. 2). In some embodiments, the decorative livery layer 78 formed by the ink applied by the ink jet print head 74 has a substantially uniform thickness 84 (within dispensing/manufacturing tolerances). Dispensing the decorative livery layer 78 with the substantially uniform thickness 84 provides aerodynamic properties and other such enhanced performance characteristics to the surface treatment coating 52.

Figure 5:
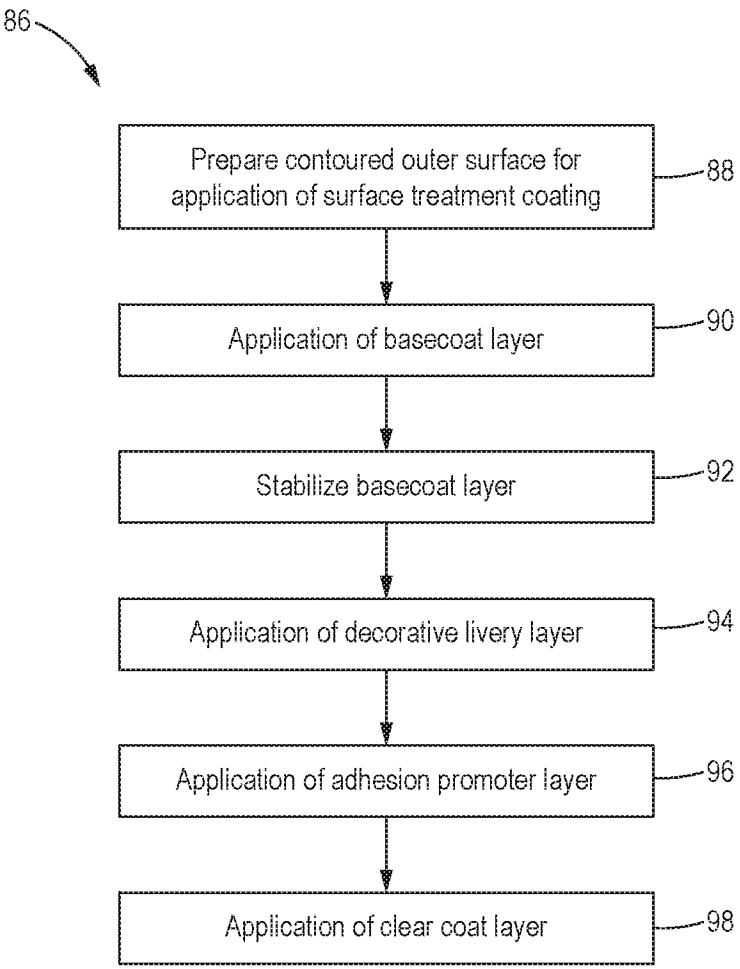
FIG. 5 is a flowchart illustrating an exemplary method of treating a contoured surface in accordance with the present disclosure.

Referring now to FIG. 5 and with continued reference to the proceeding FIGS. 1-4, a flowchart illustrating an exemplary surface treatment method or process 86 of applying the surface treatment coating 52 to the contoured outer surface 48 of the fuselage 24 is illustrated. In a first block 88 of the surface treatment method 86, a portion of the vehicle, such as an airplane fuselage 24, is prepared for surface treatment and positioned within the work area 50. In one non-limiting example, the surface preparation includes the removal of any protective or previously applied coatings on the contoured outer surface 48 or other such outer surface of the portion of the vehicle 20 to be treated. Moreover, the surface preparation includes masking or otherwise covering up certain areas of the contoured outer surface 48 not to be treated. Additionally, surface preparation includes abrading, cleaning, washing/drying and other such procedures to remove any contaminants or other surface imperfections along the contoured outer surface 48 of the vehicle 20. Once the contoured outer surface 48 is properly cleaned, one or more preliminary coatings are applied along the contoured outer surface 48 or other surface of the vehicle 20 to be treated. In some embodiments, the one or more preliminary coatings include a surface film, a sol-gel coating, a primer layer, an intermediate coating and/or other such preliminary coatings. As mentioned above, the fuselage 24 is typically constructed out of aluminum, aluminum alloy, titanium, carbon composite, or other known material and any combinations thereof. Accordingly, the contoured outer surface 48 may have surface imperfections or other such conditions that impact the quality of the surface treatment coating 52. Thus, the one or more preliminary coatings help to prepare a smooth surface for the subsequent layers of the surface treatment coating 52 by filling in and/or removing defects present in the surface to be treated. Additionally, the one or more preliminary coatings provide an initial protective barrier against corrosion and other environmental conditions that the fuselage 24 the vehicle 20 may encounter during operation.

In a next block 90, following the completion of applying the preliminary coatings, the basecoat layer 81 is applied along the contoured outer surface 48 of the fuselage 24 or other surface of the vehicle to be treated. In one non-limiting example, the application of the basecoat layer 81 includes a wait period following the application of the basecoat layer 81 along the contoured outer surface 48. For example, a wait period of 30 minutes may be incorporated to allow solvent or other volatile components of the basecoat to evaporate or otherwise dry. Note, 30 minutes is one non-limiting example of the wait period length; however other lengths (e.g., shorter or longer) are possible. Following the wait period to allow for solvent evaporation, in a next block 92 the fuselage 24, or other treated portion of the vehicle 20, is exposed to an elevated temperature within the work area 50 for curing the basecoat layer 81. In one embodiment, an accelerated cure process is used by exposing the fuselage 24 or other treated portion of the vehicle 20, to an elevated temperature for a pre-determined amount of time. The elevated temperature is a temperature that is above room temperature (room temperature is defined as approximately 75° F.) and the elevated temperature is selected based upon material properties of the basecoat layer 81 applied to the contoured outer surface 48, as well as the material properties of other coatings and/or components of the fuselage 24. Additionally, the pre-determined time used for curing the basecoat layer 81 is selected based on stabilizing the basecoat layer 81 such that the basecoat layer 81 exhibits a desired wetting and other such surface properties. In one non-limiting example, an elevated temperature (i.e., greater than room temperature) for a pre-determined amount of time will reduce the amount of time it takes to stabilize the basecoat layer 81 to sufficiently cure. Alternatively, the basecoat layer 81 can be cured at room temperature (e.g., 75° F.); however curing at the lower temperature may require a longer stabilization time, such as but not limited to, curing for at least 8 hours, in order to sufficiently stabilize the basecoat layer 81.

In a next block 94, the decorative livery layer 78 is applied to the contoured outer surface 48 of the fuselage 24. As discussed in block 92, the basecoat layer 81 is sufficiently cured to provide a suitable or otherwise stable surface for the application of the decorative livery layer 78. In one non-limiting example, the basecoat layer 81 is sufficiently cured such that the contoured outer surface 48 coated with the basecoat layer 81 has stabilized. As a result, the ink droplets dispensed by the ink jet print heads 74 will properly wet and flow along the contoured outer surface 48 as the decorative livery layer 78 is applied. Alternatively, if it is desired to limit or control the wetting of the decorative livery layer 78 the basecoat layer can be cured to a lesser degree prior to applying ink or other material in the decorative livery layer 78.

In one embodiment, the decorative livery layer 78 is formed by one or more colors of ink applied to the contoured outer surface 48 using one or more ink jet print heads 74. Accordingly, the one or more ink jet print heads 74 jet a plurality of ink droplets along the contoured outer surface 48 to form the decorative livery layer 78. Moreover, the ink jet print heads 74 are capable of printing a multi-colored pattern by jetting a plurality of ink droplets which include colors, such as but not limited to, cyan, magenta, yellow and black. Furthermore, the ink droplets are accurately dispensed from the ink jet print heads 74 such that different colored droplets (i.e., cyan, magenta, yellow and black) are capable of being simultaneously applied along the contoured outer surface 48 to produce the multi-colored design of the decorative livery layer 78. Thus, in some embodiments, the accuracy and precision of the ink jet print heads 74 allows the surface treatment assembly 62 to apply the decorative livery layer 78 without the need to overlay a mask layer on the contoured outer surface 48 to define different colored layers of the decorative livery layer 78. As illustrated in FIG. 4, the elimination of the mask layer allows the plurality of ink jet print heads 74 to dispense the decorative livery layer 78 with a substantially uniform thickness 84.

Additionally, the ability to apply the decorative livery layer 78 using the ink jet print heads 74 provides several advantages when applying the surface treatment coating 52 to the contoured outer surface 48 of the fuselage 24. For example, the ink jet print heads 74 can be accurately and precisely controlled to jet or otherwise dispense ink droplets having a droplet volume between 20-40 picoliters and a droplet size between 50-200 microns. In some embodiments, the droplet size can be controlled based on a desired amount of droplet wetting that occurs along the surface following dispensing of the droplet by the ink jet print heads 74. Accordingly, the droplet may be one size (i.e., smaller dimension) when first dispensed and the droplet may be a second size (i.e., larger dimension) following the droplet wetting along the contoured outer surface 48. Furthermore, the ink jet print heads 74 can be controlled to accurately dispense the plurality of ink droplets at the desired location along the contoured outer surface 48. Note, the placement accuracy of ink jet droplets will depend upon known process tolerances and/or capabilities of the ink jet print heads 74 and other components of the surface treatment assembly 62.

Thus, the ink jet print heads 74 are able to simultaneously jet or dispense a variety of colored ink droplets to create the multi-colored decorative livery layer 78. The simultaneous jetting of colors eliminates the need to use one or more masking layers to create a multi-colored pattern as part of the decorative livery layer 78. As a result, the time needed to apply the decorative livery layer 78 is reduced because one or more masking layers do not need to be applied to the contoured outer surface 48 for each different color application. Additionally, the ink jet print heads 74 may use a reduced amount of material to apply the decorative livery layer 78 than other methods such as paint applicators and the like. For example, the ink dispensed by the ink jet print heads 74 can produce a layer that is approximately 0.3-0.7 mils thick when dry, opposed to paint layers that produce layers that are at least 1-6 mils thick when dry. Therefore, the ink jet print heads 74 are capable of using less material (i.e., ink) when jetting or otherwise dispensing the decorative livery layer 78 along the contoured outer surface 48.

Moreover, as illustrated in FIG. 4, the ink jet print heads 74 dispense the multi-colored decorative livery layer 78 in an ink layer that has a substantially (i.e., within manufacturing tolerances) uniform thickness 84. In one non-limiting example, the decorative livery layer 78 dispensed by the ink jet print heads 74 has a thickness around 0.3 mils; however other thicknesses are possible. Moreover, jetting or otherwise dispensing the decorative livery layer 78 with the uniform thickness 84 provides an improved aerodynamic surface along the contoured outer surface 48 of the fuselage 24.

Following the application of the decorative livery layer 78, in a next block 96 the adhesion promoter layer 83 is applied on top of the decorative livery layer 78. In some embodiments, the ink used to create the decorative livery layer 78 includes solvents which help with the jetting or dispensing of the ink by the ink jet print heads 74. Accordingly, a pre-determined wait time after the decorative livery layer 78 is dispensed by the ink jet print heads 74 is used to allow evaporation of solvent and other volatile components from the ink. Alternatively, the ink used to create the decorative livery layer 78 includes ultra-violet (UV) light sensitive components that are cured with UV light following the dispense of the ink by the ink jet print heads 74. Following the wait time and application of the adhesion promoter layer 83, in a next block 98, the clear coat layer 82 is dispensed along the contoured outer surface 48. The clear coat layer 82 is a transparent protective layer that covers or otherwise encapsulates the underlying decorative livery layer 78. As a result, the clear coat layer 82 provides a protective barrier that improves durability and resistance against environmental conditions of the underlying decorative livery layer 78.

Furthermore, in some embodiments a pre-determined stabilizing time is followed after the adhesion promoter layer 83 application in block 96. The length of the stabilizing or drying time is determined based on a desired surface preparation for the adhesion promoter layer 83. The adhesion promoter layer 83 generally provides an interface between the underlying decorative livery layer 78 and the overlaying clear coat layer 82. Furthermore, the adhesion promoter layer 83 may tailor the chemical and physical bonding forces to produce a strong and durable bond between the clear coat layer 82 and the adhesion promoter layer 83. Accordingly, when the adhesion promoter layer 83 is properly stabilized the clear coat layer 82 is able to form a continuous and conformal layer which protects the underlying decorative livery layer 78 and other layers of the surface treatment coating 52.

While the foregoing detailed description has been given and provided with respect to certain specific embodiments, it is to be understood that the scope of the disclosure should not be limited to such embodiments, but that the same are provided simply for enablement and best mode purposes. The breadth and spirit of the present disclosure is broader than the embodiments specifically disclosed and encompassed within the claims appended hereto. Moreover, while some features are described in conjunction with certain specific embodiments, these features are not limited to use with only the embodiment with which they are described, but instead may be used together with or separate from, other features disclosed in conjunction with alternate embodiments.

What is claimed is:

1. A method of treating a contoured outer surface with a surface treatment coating, the method comprising:

applying a surface preparation layer along the contoured outer surface;

applying a basecoat layer on top of the surface preparation layer and along the contoured outer surface;

stabilizing the basecoat layer to prepare a basecoat surface for one or more subsequent layers of the surface treatment coating;

jetting a decorative livery layer along the contoured outer surface using one or more ink jet print heads;

applying an adhesion promoter layer on top of the decorative livery layer;

stabilizing the adhesion promoter layer to produce a desired bonding surface along the adhesion promoter layer; and applying a clear coat layer to cover the decorative livery layer, the basecoat layer and the surface preparation layer.

2. The method of claim 1, wherein the surface preparation layer includes one or more of a surface film, a sol-gel layer, a primer layer, and an intermediate layer.

3. The method of claim 1, wherein stabilizing the basecoat layer includes evaporating one or more basecoat volatile materials from the basecoat layer.

4. The method of claim 3, wherein stabilizing the basecoat layer further includes curing the basecoat layer at an elevated temperature for a pre-determined time.

5. The method of claim 4, wherein the basecoat layer is cured sufficiently to promote wetting of the decorative livery layer along the contoured outer surface.

6. The method of claim 1, wherein the decorative livery layer includes a plurality of different colored inks, and wherein jetting the decorative livery layer produces a multi-colored layer having a uniform thickness.

7. The method of claim 6, wherein the multi-colored layer is formed from a plurality of ink drops dispensed by the one or more ink jet print heads and each ink drop of the plurality of ink drops has an approximate volume of at least 30 picoliters.

8. A method of applying a decorative livery layer along a contoured outer surface of an airplane fuselage, the method comprising:

positioning the airplane fuselage within a work area;

preparing the contoured outer surface of the airplane fuselage for receiving a surface treatment coating;

applying a surface preparation layer along the contoured outer surface;

jetting a decorative livery layer along the contoured outer surface using one or more ink jet print heads;

applying an adhesion promoter layer on top of the decorative livery layer;

stabilizing the adhesion promoter layer to produce a desired bonding surface along the adhesion promoter layer; and applying a clear coat layer to cover the decorative livery layer, and the surface preparation layer.

9. The method of claim 8, wherein preparing the contoured outer surface includes performing at least one of abrading, cleaning, washing, and drying the contoured outer surface.

10. The method of claim 8, wherein the surface preparation layer includes one or more of a surface film, a sol-gel layer, a primer layer, and an intermediate layer.

11. The method of claim 8, further comprising applying a basecoat layer on top of the surface preparation layer and wherein applying the basecoat layer includes stabilizing the basecoat layer to prepare a basecoat surface for one or more subsequent layers of the surface treatment coating.

12. The method of claim 11, wherein stabilizing the basecoat layer further includes curing the basecoat layer at an elevated temperature for a pre-determined time.

13. The method of claim 12, wherein the basecoat layer is cured sufficiently to promote wetting of the decorative livery layer along the contoured outer surface.

14. The method of claim 8, wherein the decorative livery layer includes a plurality of different colored inks, and wherein jetting the decorative livery layer produces a decorative layer with one or more colors and having a uniform thickness.

15. The method of claim 14, wherein the decorative layer with one or more colors is formed from a plurality of ink drops dispensed by the one or more ink jet print heads and each ink drop of the plurality of ink drops has an approximate volume of at least 30 picoliters.

16. A method of ink jetting a decorative livery layer along a contoured outer surface of an aircraft using a surface treatment assembly with one or more ink jet print heads, the method comprising:

applying a surface preparation layer along the contoured outer surface, the surface preparation layer includes one or more of a surface film, a sol-gel layer, a primer layer, and an intermediate layer;

applying a basecoat layer on top of the surface preparation layer and along the contoured outer surface;

curing the basecoat layer sufficiently to stabilize the basecoat layer;

jetting a decorative livery layer along the contoured outer surface using the surface treatment assembly;

flashing one or more volatile components from the decorative livery layer;

applying an adhesion promoter layer on top of the decorative livery layer;

stabilizing the adhesion promoter layer to produce a desired bonding surface along the adhesion promoter layer; and applying a clear coat layer to cover the decorative livery layer, the basecoat layer and the surface preparation layer.

17. The method of claim 16, wherein curing the basecoat layer comprises heating the basecoat layer at an elevated temperature for a pre-determined time.

18. The method of claim 16, wherein the decorative livery layer includes a plurality of different colored inks, and wherein jetting the decorative livery layer produces a multi-colored layer having a uniform thickness.

19. The method of claim 18, wherein the multi-colored layer is formed from a plurality of ink drops dispensed by the one or more ink jet print heads and each ink drop of the plurality of ink drops has an approximate volume of at least 30 picoliters.

20. The method of claim 16, wherein the basecoat layer is cured sufficiently to promote wetting of the decorative livery layer along the contoured outer surface.

* * * * *